US009790571B2

(12) United States Patent
Marques et al.

(10) Patent No.: US 9,790,571 B2
(45) Date of Patent: Oct. 17, 2017

(54) PROCESS FOR REMOVING URANIUM IN COPPER CONCENTRATE VIA MAGNETIC SEPARATION

(71) Applicant: VALE S.A., Rio de Janeiro (FR)

(72) Inventors: Antonio Euclides Jaques Marques, Belo Horizonte (BR); Wesley José Da Silva, Belo Horizonte (BR); Mauricio Guimarães Bergerman, Poços de Caldas (BR); Wendel Johnson Rodrigues, Louveira (BR); Keila Lane de Carvalho Gonçalves, Belo Horizonte (BR)

(73) Assignee: VALE S.A, Rio de Janeiro (BR)

( * ) Notice: Subject to any disclaimer, the term of this patent is extended or adjusted under 35 U.S.C. 154(b) by 556 days.

(21) Appl. No.: 14/073,674

(22) Filed: Nov. 6, 2013

(65) Prior Publication Data

US 2014/0137703 A1 May 22, 2014

Related U.S. Application Data

(60) Provisional application No. 61/723,196, filed on Nov. 6, 2012.

(51) Int. Cl.

| | |
|---|---|
| ***C22B 7/00*** | (2006.01) |
| ***C22B 60/02*** | (2006.01) |
| ***C22B 15/00*** | (2006.01) |

(52) U.S. Cl.
CPC ..... *C22B 7/005* (2013.01); *C22B 15/0002* (2013.01); *C22B 15/0006* (2013.01); *C22B 60/0208* (2013.01)

(58) Field of Classification Search
CPC . C22B 7/005; C22B 15/0006; C22B 15/0002; C22B 60/0208
USPC ..... 423/3, 25, 26
See application file for complete search history.

(56) References Cited

U.S. PATENT DOCUMENTS

| | | | | |
|---|---|---|---|---|
| 3,935,094 A * | 1/1976 | Bergeron | B03C 1/00 209/214 |
| 7,360,657 B2 * | 4/2008 | Oder | B01D 35/06 209/213 |
| 2008/0173132 A1 * | 7/2008 | Dunn | C22B 15/0008 75/399 |

OTHER PUBLICATIONS

Padmanabhan, et al., "Process parametric study for the recovery of very-fine size uranium values on super-conducting high gradient magnetic separator" Advanced Powder Technology, 22,(2011), pp. 131-137.*

* cited by examiner

*Primary Examiner* — Steven Bos
(74) *Attorney, Agent, or Firm* — Arent Fox LLP

(57) ABSTRACT

The present invention describes a process for removing uranium from a copper concentrate by magnetic separation (low and high field) to reduce the uranium content to commercially acceptable levels.

6 Claims, 14 Drawing Sheets

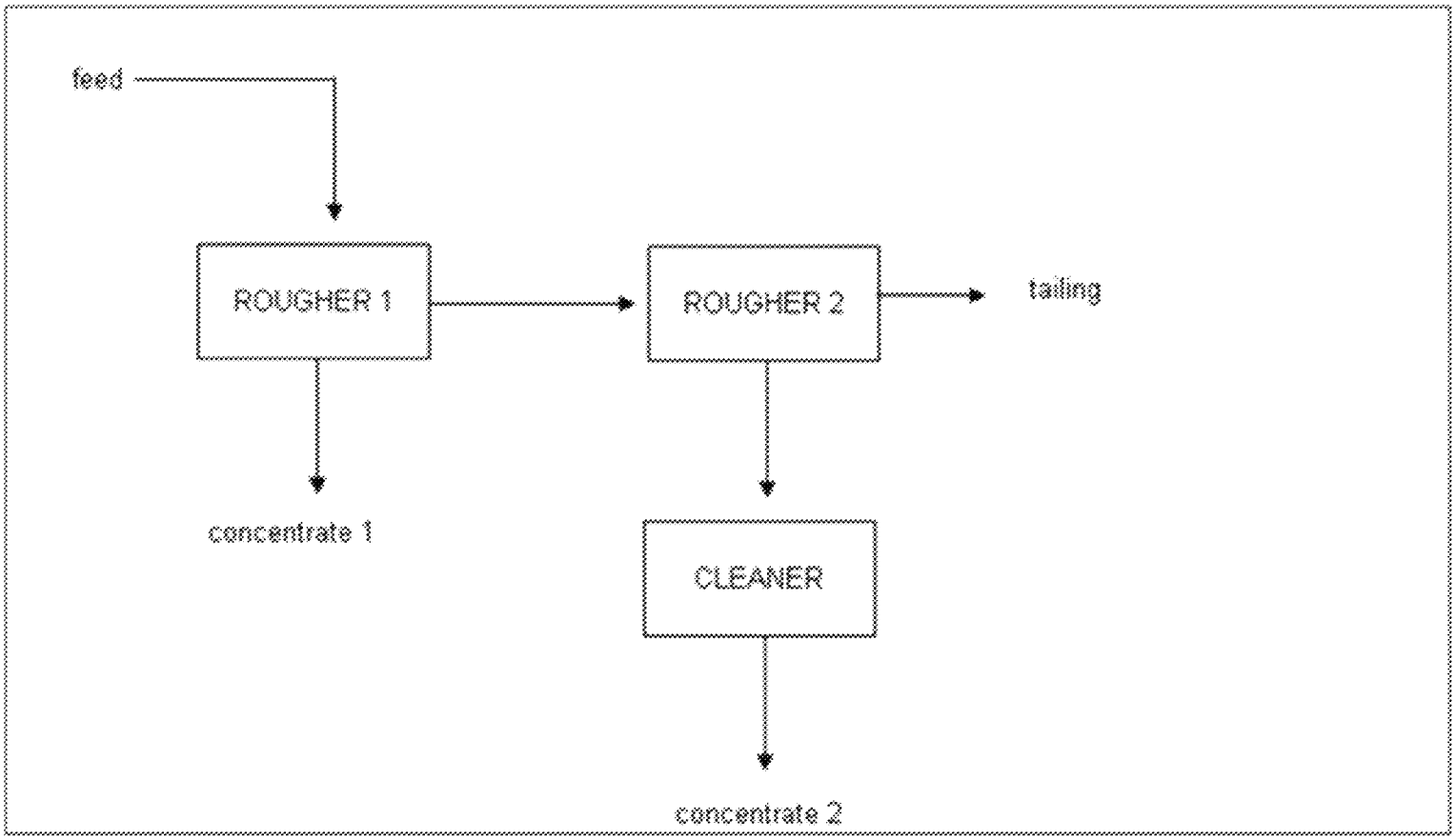
Fig. 1 – Fine flotation of the cleaner flotation circulating load

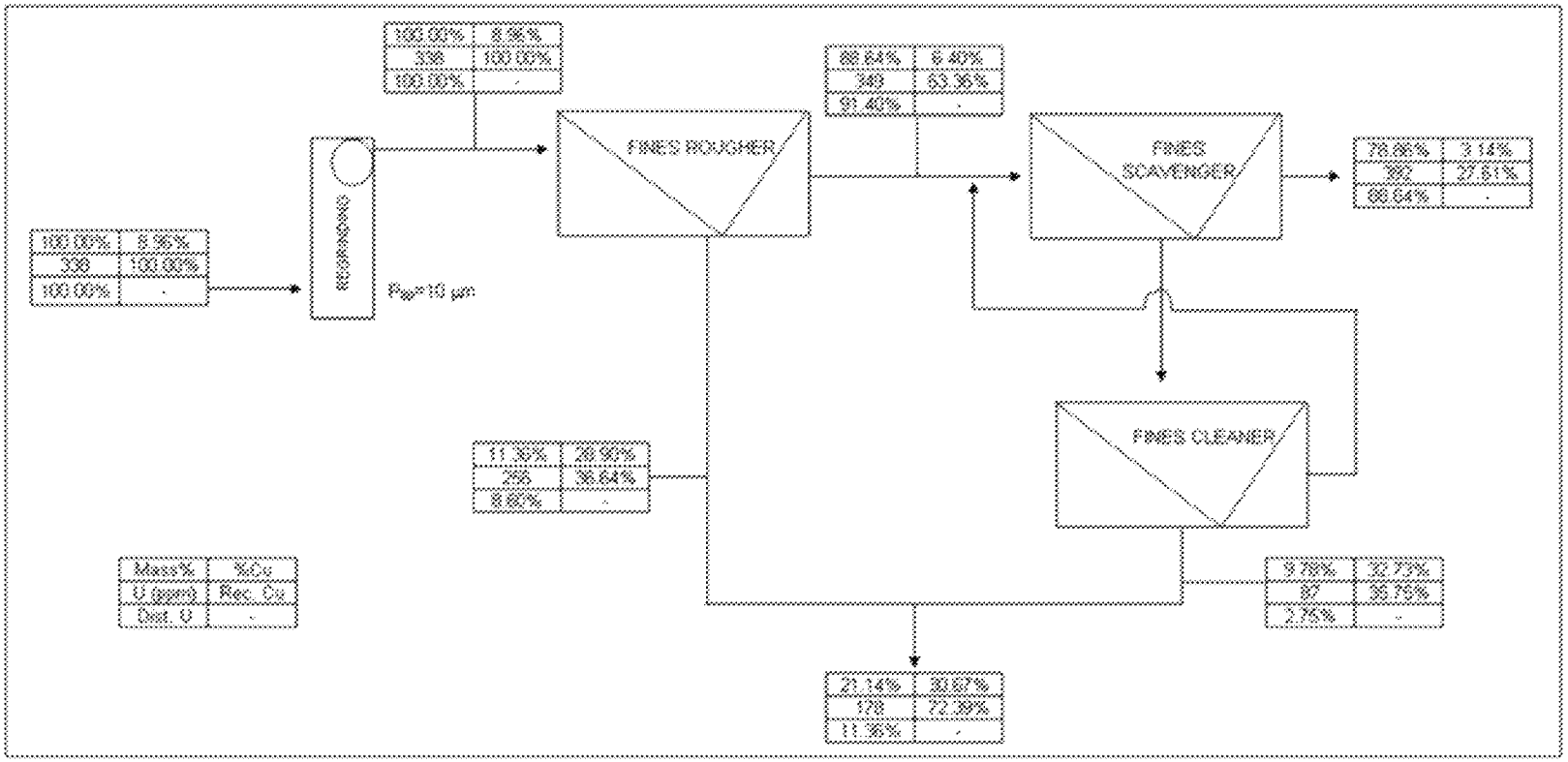
Fig. 2 – Flowchart of the concentration of the circulating load from cleaner flotation

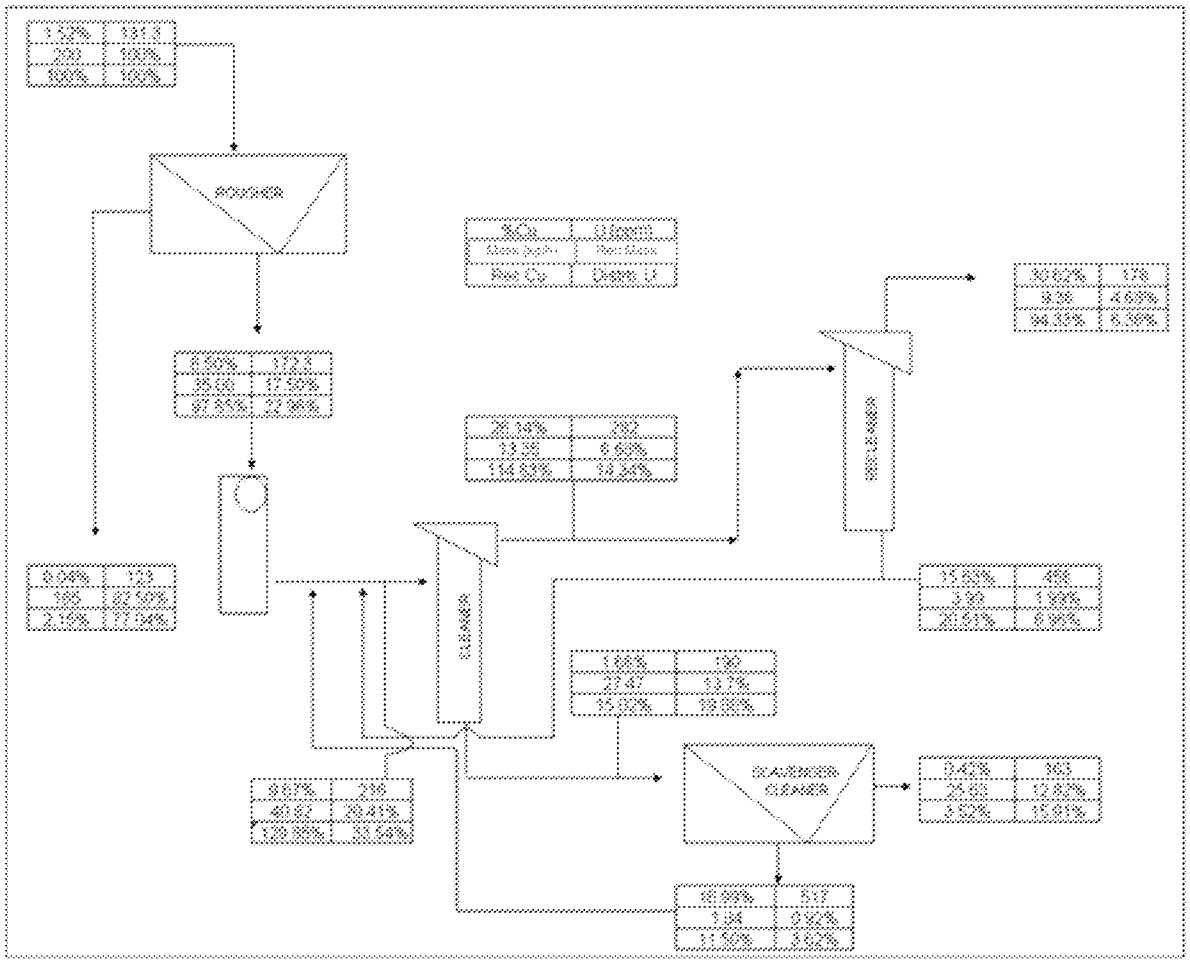
Fig. 3 -- Flotation flowchart of the run 2

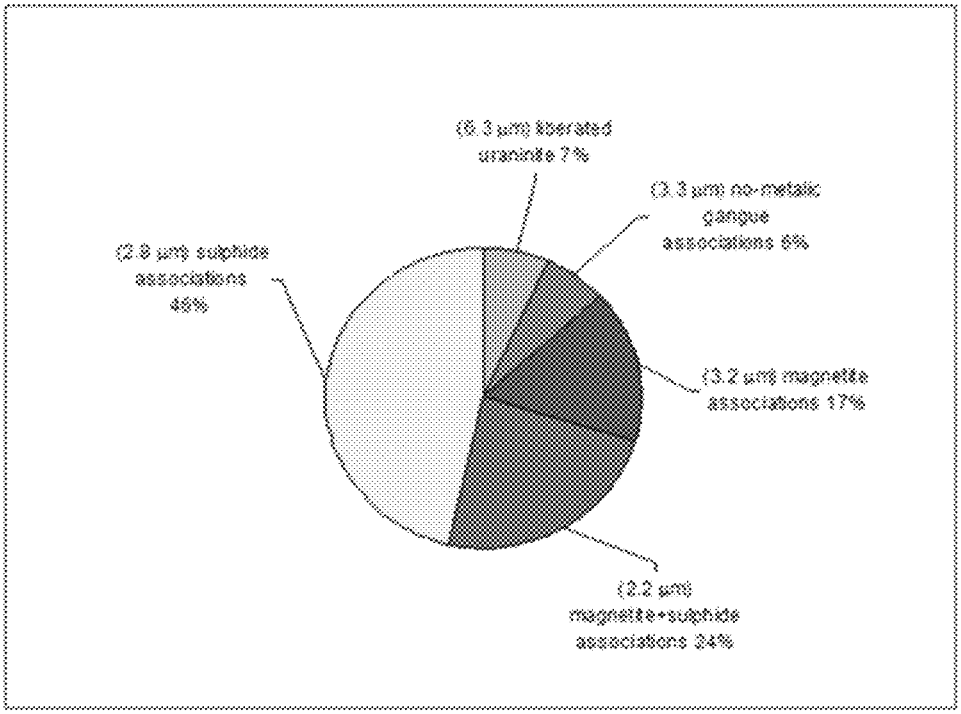
Fig. 4 - Distribution of the U-Pb oxides in re-cleaner concentrate (run 2–closed circuit)
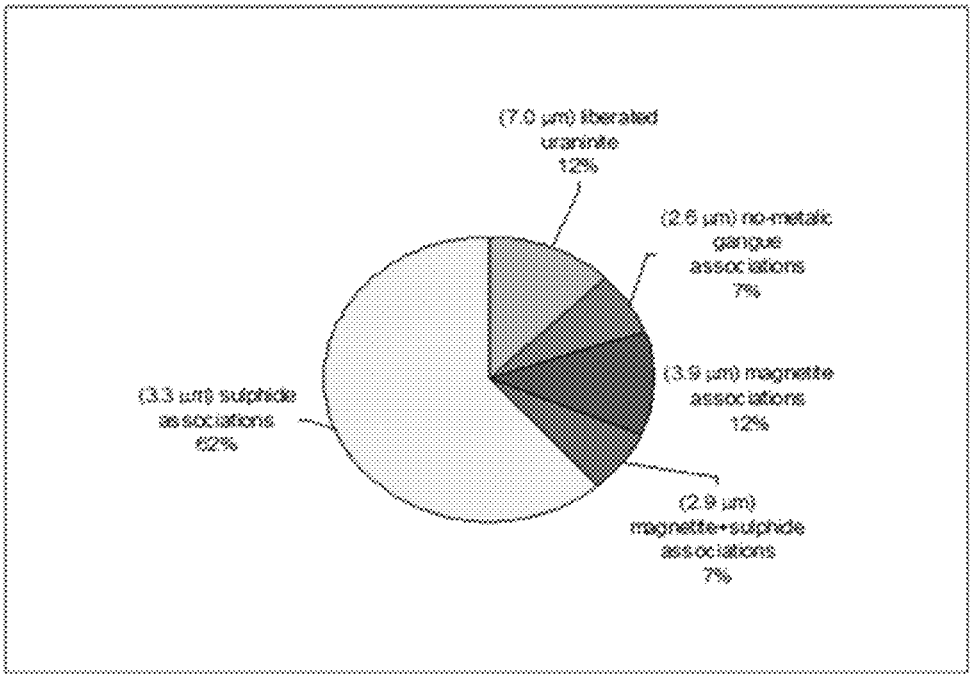
Fig. 5 - Distribution of the U-Pb oxides in re-cleaner concentrate (run 3–open circuit)

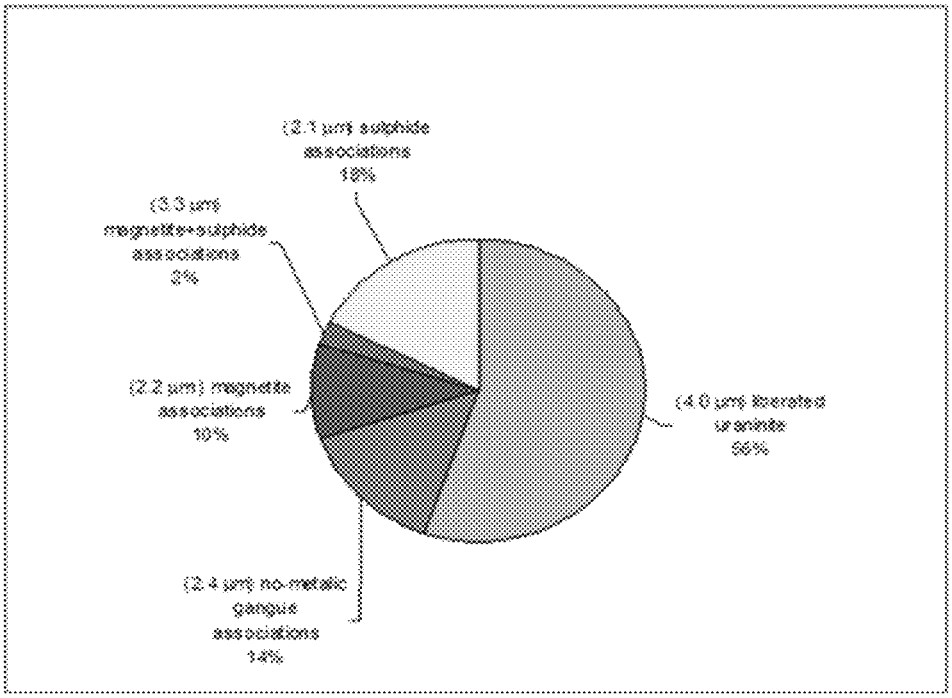
Fig. 6 - Distribution of the U-Pb oxides in scavenger-cleaner concentrate (run 3–open circuit)

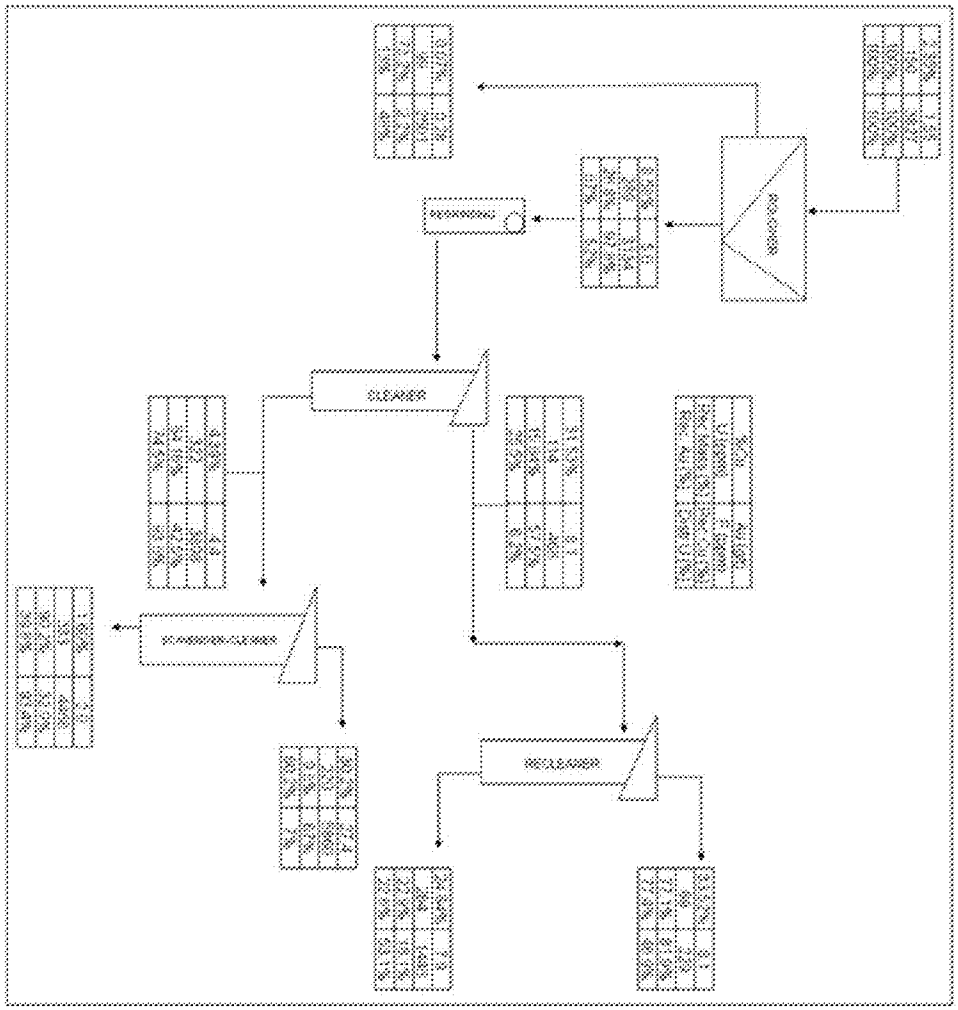
Fig. 7 - Flotation flowchart of runs 1 and 2.

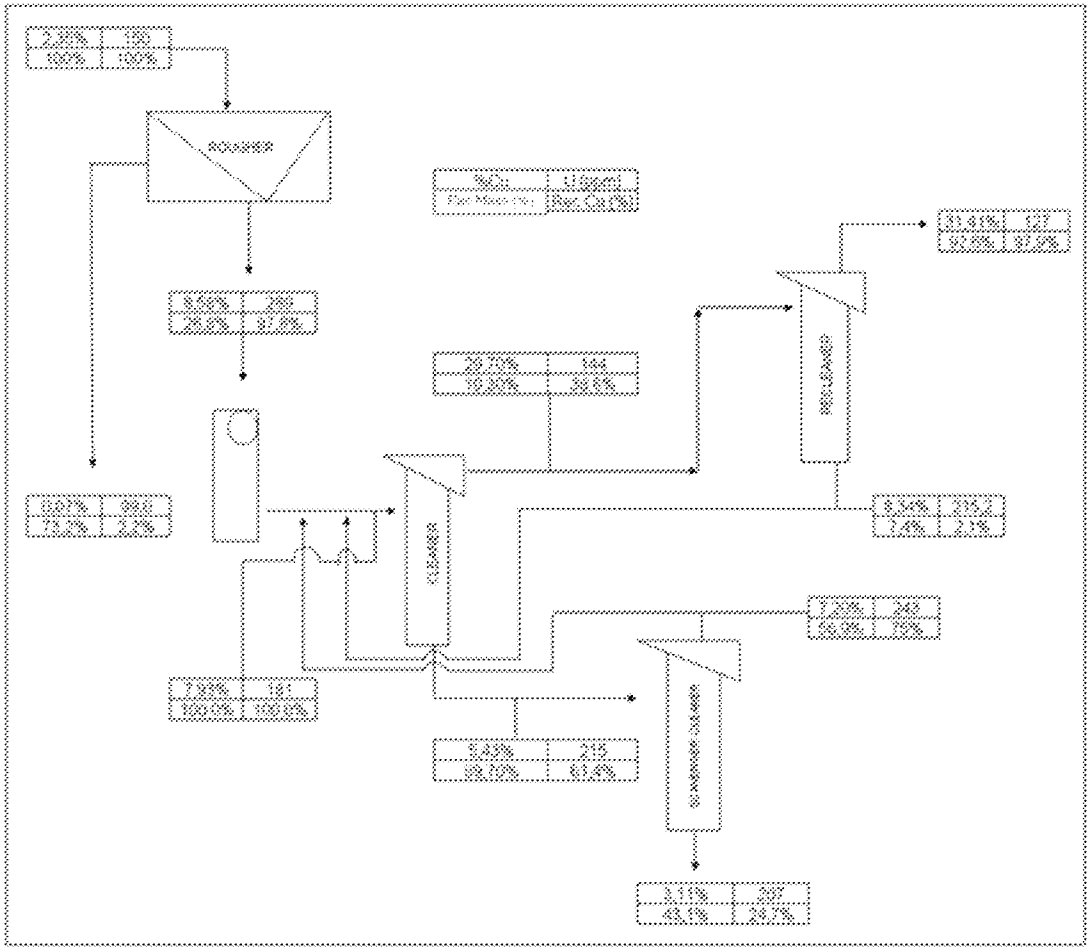
Fig. 8 - Shows average values of grade and distribution for copper and uranium in the flotation runs.

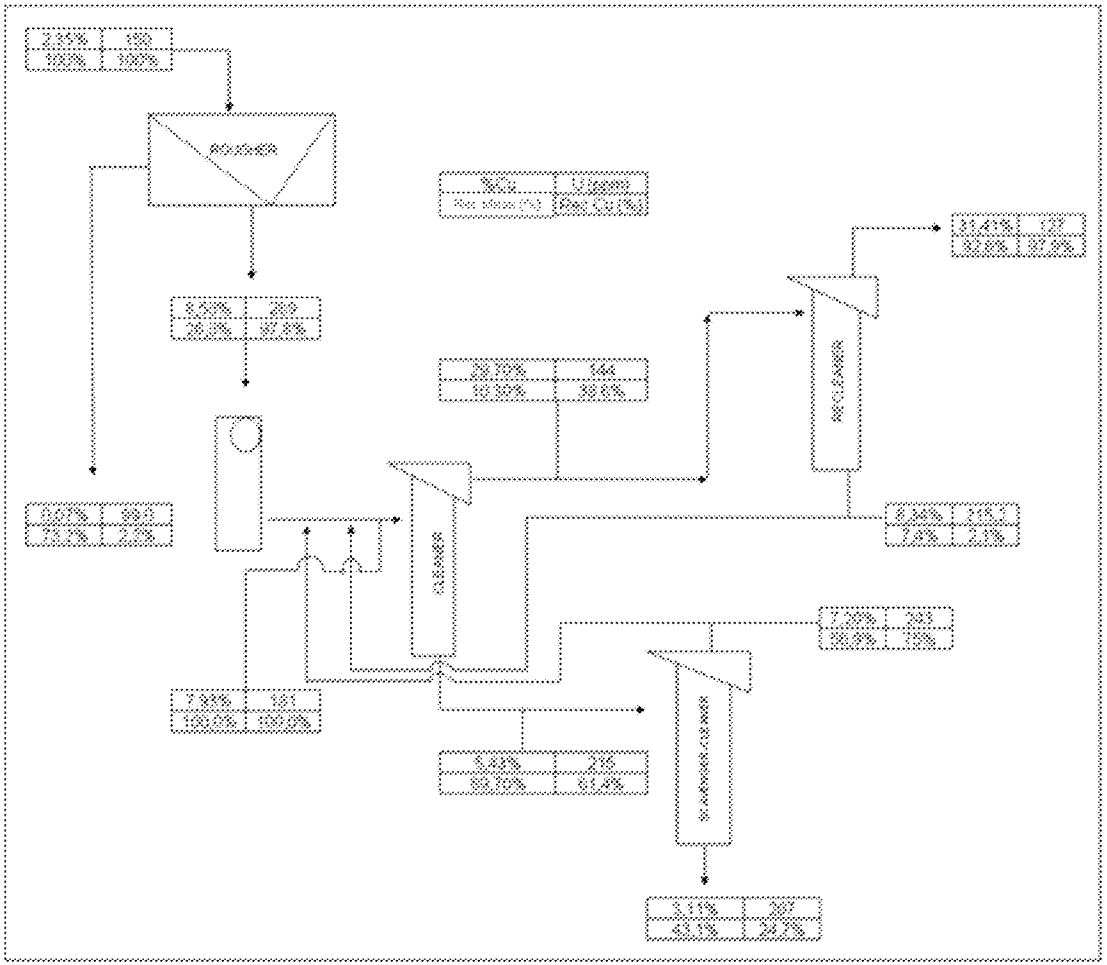
Figure 9 - Flotation flowchart of closed cleaner circuit from sample II

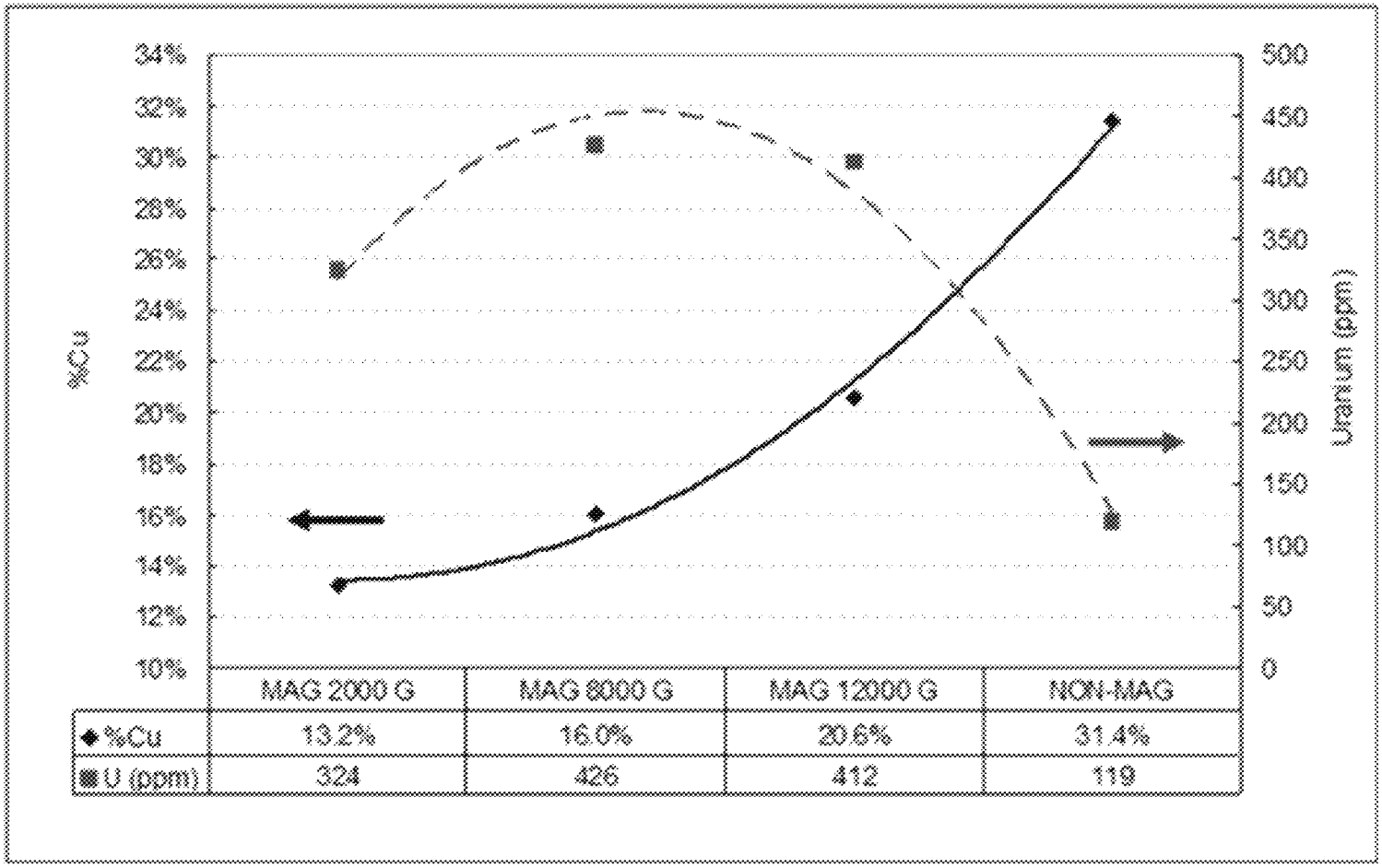
Fig. 10 - Copper and uranium grade in the magnetic separation of recleaner flotation concentrate (closed cleaner circuit - sample II)

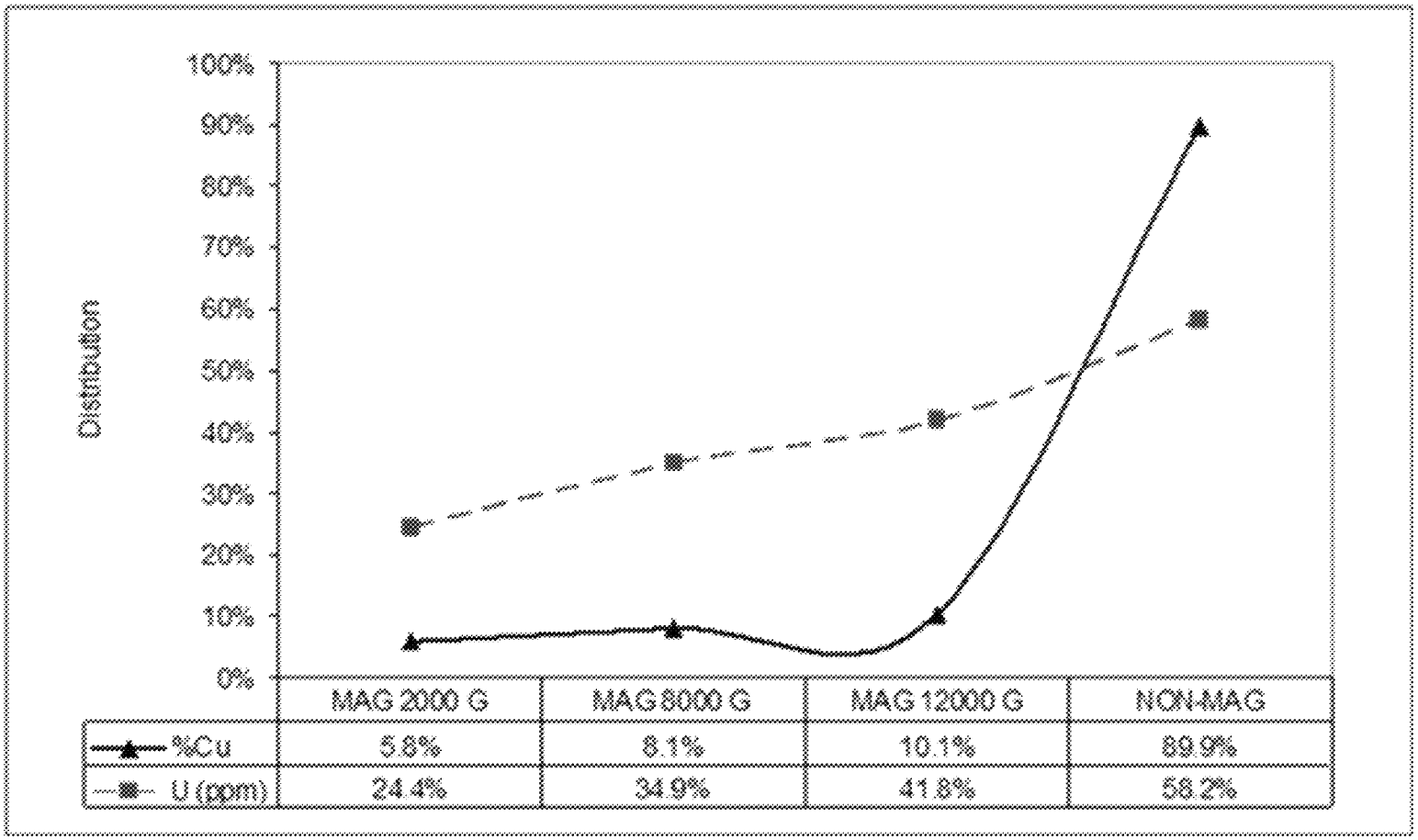
Fig. 11 - Copper and uranium distribution in the magnetic separation of recleaner flotation concentrate (closed cleaner circuit - sample II)

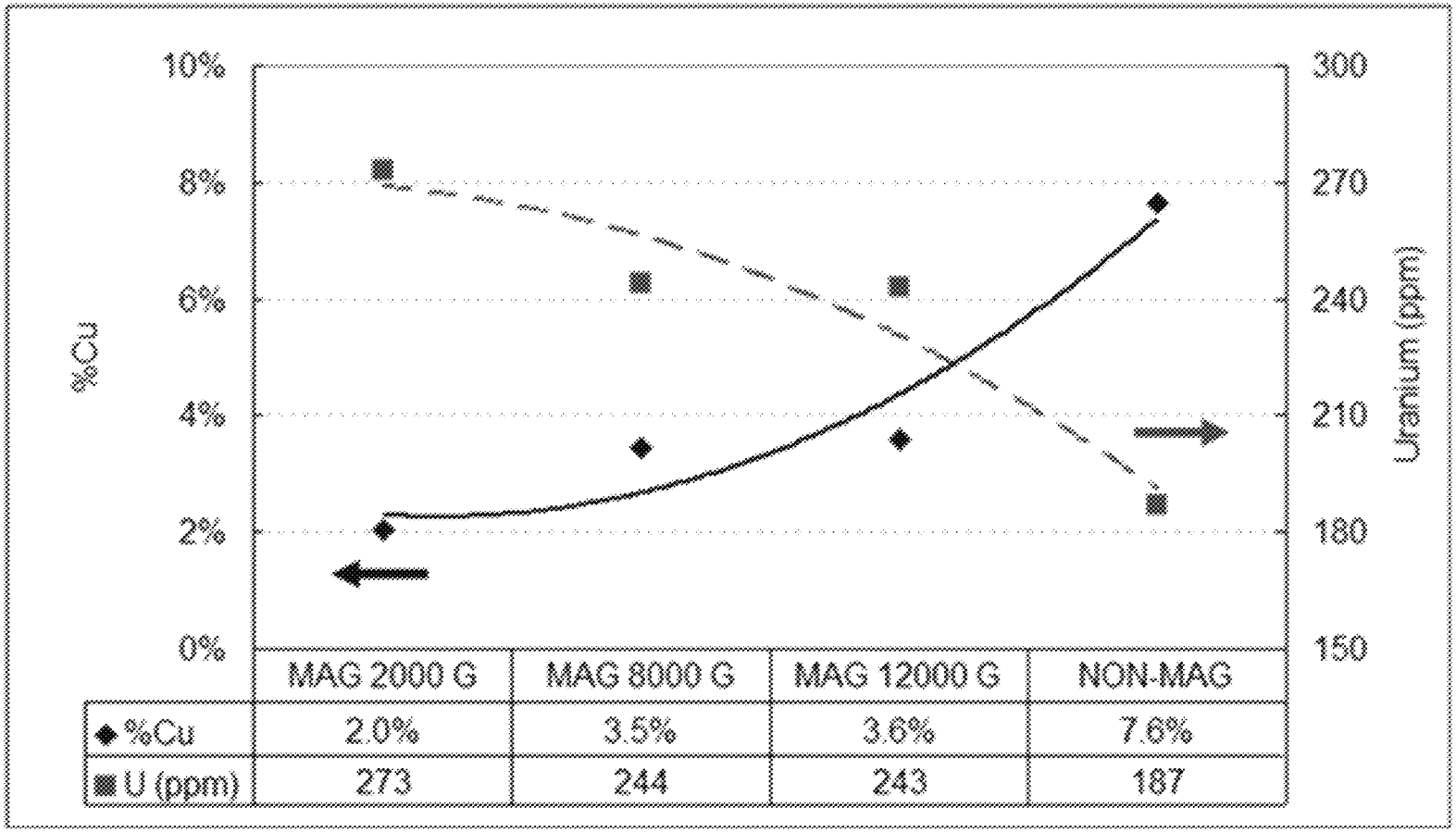
Fig. 12 - Copper and uranium grade in the magnetic separation of scavenger-cleaner flotation concentrate (closed circuit cleaner)

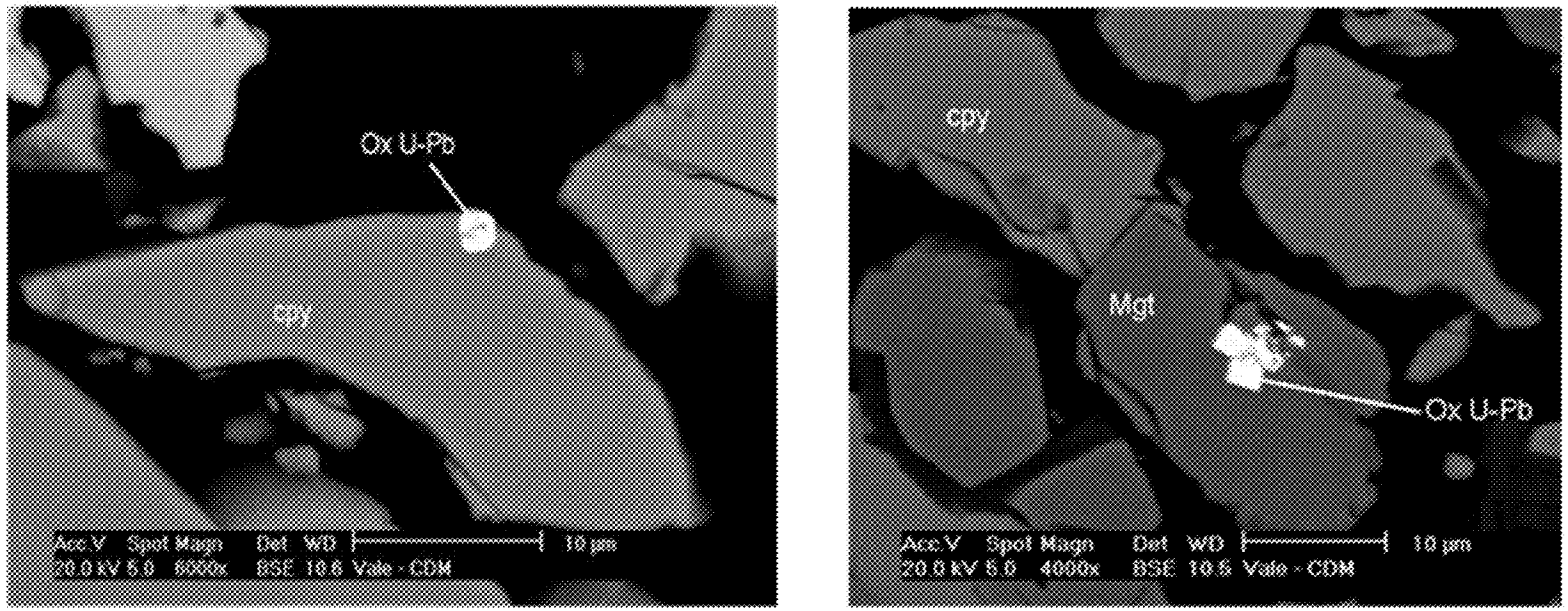
Fig. 13 - Micrograph showing the features of uraninite associations in magnetic separation products - (A) non-magnetic product and (B) magnetic product

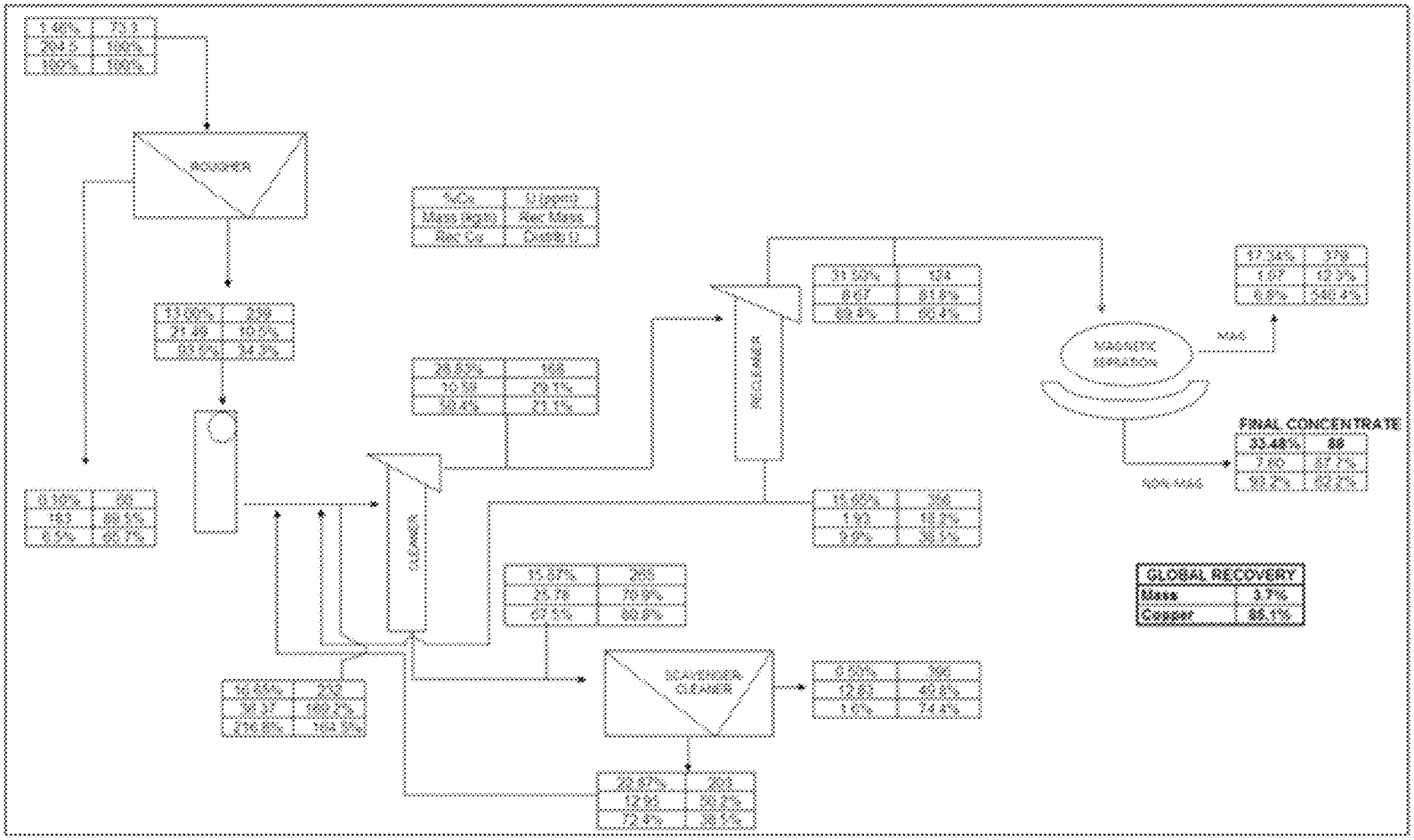
Fig. 14 – 3rd plant experiment

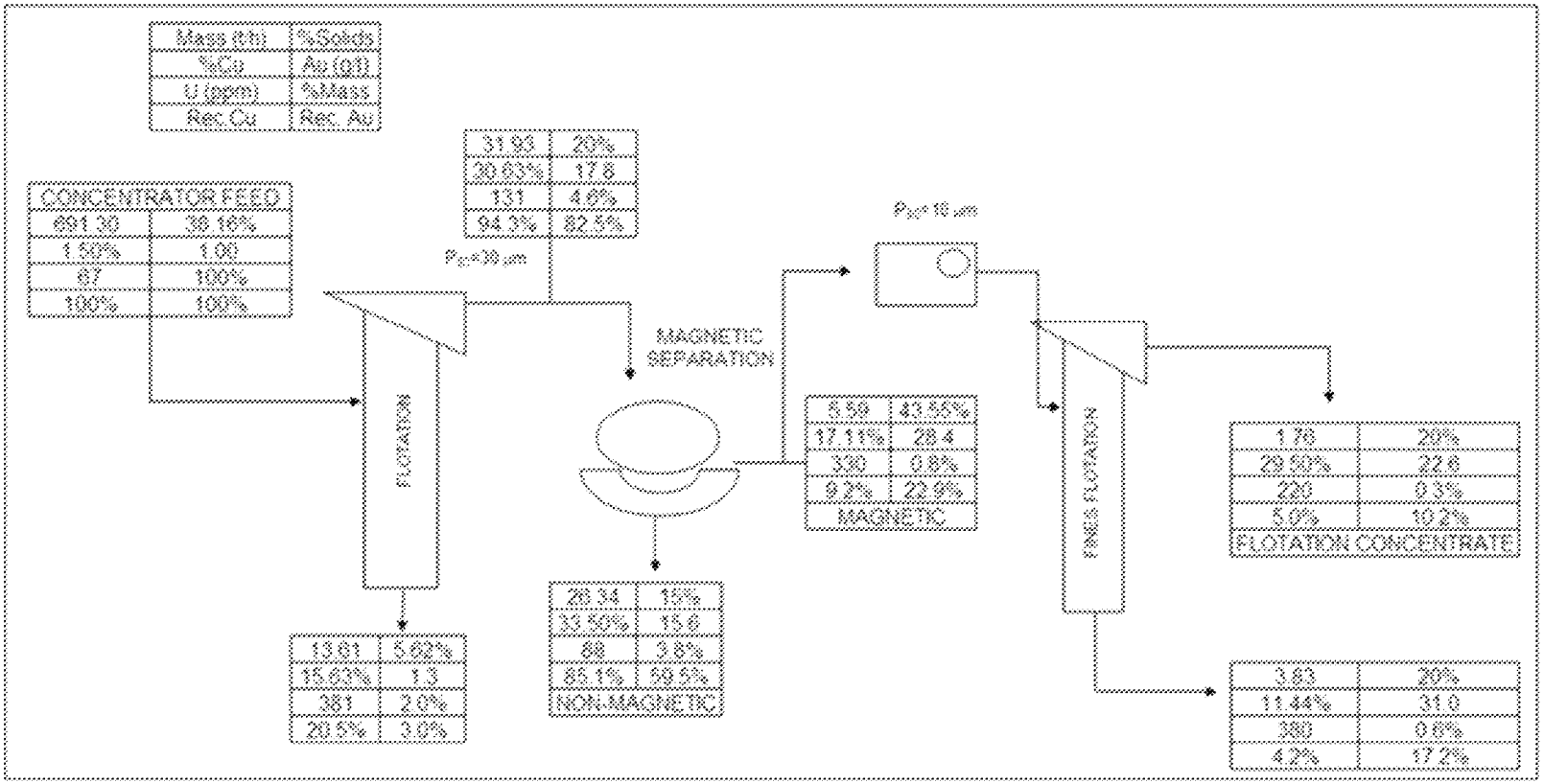
Fig. 15 - Mass balance of concentrator with flotation from the magnetic separation

PROCESS FOR REMOVING URANIUM IN COPPER CONCENTRATE VIA MAGNETIC SEPARATION

This application claims priority from U.S. Patent Application No. 61/723,196, entitled "Process for removing uranium in copper concentrate via magnetic separation," filed on Nov. 6, 2012, which is incorporated herein by reference in its entirety.

FIELD OF THE INVENTION

The present invention refers to a process of removing uranium from a copper concentrate by magnetic separation with the aim of reducing the content of uranium in a copper concentrate to commercially acceptable levels.

BACKGROUND OF THE INVENTION

There are many techniques used with magnetic separation, especially on processes for removing uranium from a copper concentrate. As it is known, the efficiency of the separation is dependent on several factors, including resistance time in magnetic field, the releasing of the constituent minerals, and competing forces such as gravity and friction.

David C. Dahlin and Albert R. Rule have described that the U.S. Bureau of Mines has investigated the magnetic susceptibility of minerals as in a function of magnetic field strength to determine how that association might affect the potential of high-field magnetic separation as an alternative to other separation technologies. Single-mineral concentrates were prepared with samples from the same deposit in order to compare magnetic susceptibilities of minerals that occur together. Moreover, the concentrates were prepared with samples from different deposits to compare magnetic susceptibilities of such minerals. The result of their research showed that magnetic susceptibility of minerals is essentially independent of magnetic field strength, after saturation with ferromagnetic compounds.

In view of that information, a magnetic separation technology based on enhancement of minerals' susceptibilities in high magnetic fields is unlikely and new.

Concerning separation processes of metals, wet high intensity magnetic separation (WHIMS) or magnetic filtration are techniques known by any person skilled in the art. Such techniques are useful for removing magnetic impurities.

The advantages of magnetic filtration are reduced pollution and high metal recovery. Unlike other beneficiation processes, magnetic filtration can be readily used on micron-sized particles, although this technology requires a high capital cost.

Another prior art process regarding magnetic separation is disclosed by A. R. Schake, et al. The article teaches that High-Gradient Magnetic separation (HGMS) can be used to concentrate plutonium and uranium in waste streams and contaminated soils. The advantages of this technology are that it does not create additional waste and reduces the chemical reagents for further remediation.

Generally, magnetic separation technology can be used in a wide range of applications in the mining industry. U.S. Pat. No. 7,360,657 describes a method and apparatus for continuous magnetic separation to separate solid magnetic particles from slurry, providing a substantially vertical magnetic separator comprising a container disposed to introduce a continuous flow of slurry feed.

The purification of ilmenite from very low chromium concentrates is illustrated in U.S. Pat. No. 3,935,094. The ilmenite concentrate is subjected to a wet magnetic separation and the high magnetic susceptible chromite contaminant is removed therefrom. Then, the non-magnetic part is subjected to a furnace under oxidizing conditions and a slight increase in weight of ilmenite is observed during the oxidization. Thereafter, the oxidized ilmenite is magnetically susceptible and is separated from the chromites.

Superconducting magnetic separation is a technology with enhanced efficiency of removal of weakly magnetic minerals as well as a lower processing cost. The use of superconducting magnetic separation can be applied to improve brightness in kaolin. Furthermore, a magnetic rare-earth drum separator can be applied to reduce the uranium and thorium levels from ilmenite concentrates.

Experimental studies were carried out on superconducting high gradient magnetic separator (SC-HGMS), with a low grade (assaying <100 ppm $U_3O_8$) uranium ore, prepared from Rakha copper plant tailings in which uranium occurs as uraninite. The earlier studies carried out on wet high intensity magnetic separator (WHIMS) showed that the uraninite recovery is reduced when the particle size is lower than 20 μm and it does not exceed 20% for particles smaller 5 μm. The present studies show that the SC-HGMS is able to recover the metal efficiently with very fine and ultra-fine particles, and the recovery is more than 60% with particles even smaller than 5 μm. It is thus possible to achieve significant improvement in the uraninite's overall recovery through WHIMS in tandem with SC-HGMS techniques.

SUMMARY OF THE INVENTION

In light of the above described magnetic separation techniques, the present invention describes an advantageous and effective process for removing uranium from a copper concentrate by magnetic separation (low e high field) to reduce the content of uranium in a copper concentrate to commercially acceptable levels.

Additional advantages and novel features of these aspects of the invention will be set forth in part in the description that follows, and in part will become more apparent to those skilled in the art upon examination of the following or upon learning by practice of the invention.

BRIEF DESCRIPTION OF THE DRAWINGS

Various example aspects of the systems and methods will be described in detail, with reference to the following Figures, wherein:

FIG. 1 is a flowchart illustrating the fines flotation of the cleaner flotation circulating load.

FIG. 2 is a flowchart illustrating the concentration of the circulating load from cleaner flotation.

FIG. 3 is a flotation flowchart of run 2.

FIG. 4 is a graph illustrating distribution of the U—Pb oxides in re-cleaner concentrate (run 2—closed circuit).

FIG. 5 is a graph illustrating distribution of the U—Pb oxides in re-cleaner concentrate (run 3—open circuit).

FIG. 6 is a graph illustrating distribution of the U—Pb oxides in scavenger-cleaner concentrate (run 3—open circuit).

FIG. 7 is a flotation flowchart of runs 1 and 2.

FIG. 8 shows the average values of grade and distribution for copper and uranium in the flotation runs.

FIG. 9 is a flotation flowchart of closed cleaner circuit from sample II.

FIG. 10 is a graph representing the results of the copper and uranium grade in the magnetic separation of re-cleaner flotation concentrate (closed cleaner circuit—sample II).

FIG. 11 is a graph representing copper and uranium distribution in the magnetic separation of re-cleaner flotation concentrate (closed cleaner circuit—sample II).

FIG. 12 is a graph representing copper and uranium grade in the magnetic separation of scavenger-cleaner flotation concentrate (closed circuit cleaner).

FIG. 13 is a micrograph showing the features of uraninite associations in magnetic separation products—(A) non-magnetic product and (B) magnetic product.

FIG. 14 represents 3rd plant experiment.

FIG. 15 shows mass balance of concentrator with flotation from the magnetic.

DETAILED DESCRIPTION OF THE PRESENT INVENTION

The following detailed description does not intend to, in any way, limit the scope, applicability or configuration of the invention. More specifically, the following description provides the necessary understanding for implementing the exemplary embodiments. When using the teachings provided herein, those skilled in the art will recognize suitable alternatives that can be used, without diminishing the scope of the present invention.

The present invention describes an effective process for removing uranium from copper concentrate via magnetic separation which comprises the steps of a magnetic separation, a grinding step and a fine flotation step of copper concentrates, wherein the magnetic separation step comprises the sub-steps as follows:

i—The magnetic separation of the copper concentrates to provide splitting a magnetic fraction (a) and a non-magnetic fraction (b) with size distribution of about 15-40 micron ($P_{80}$) with content of uranium from about 20 ppm to about 100 ppm, and obtaining about 75-99.99% of non-magnetic copper fraction;

ii—grinding the magnetic fraction (a) achieved in the magnetic separation i, in order to produce a magnetic copper concentrate with a fine size distribution in the range of about 5-15 micron ($P_{80}$) with high content of uranium from about 100 ppm to about 400 ppm;

iii—fine flotation using the product of step ii, thus producing a copper concentrate with a recovery of copper in the range of about 0.01% to about 25% copper, and obtaining a copper concentrate with content uranium content from about 100 ppm to about 300 ppm, using a dithio-monothiophosphate collector and frother at about pH=8.6.

iv—mixing the non-magnetic fraction (b) from the magnetic separation step i, which has a low uranium content with the concentrate achieved at the end of step iii and producing a final concentrate (c), with the content of uranium from about 40 ppm to 150 ppm and final recovery of copper in the range of about 75% to 99.99%.

Examples

1. First Plant Experiment (Sample I)

A typical sample of ore with lithological composition of magnetitic breccias (30%) and chloritic breccias (70%) was used. Sample I comprising 1.5 ton of such ore is from a core drill and its chemical analysis is presented in Table 1.

TABLE 1

Chemical analysis of sample I

| Element | Assay |
|---|---|
| Cu (%) | 1.52 |
| Au (g/t) | 0.68 |
| S (%) | 1.35 |
| Fe (%) | 23.26 |
| U (ppm) | 131 |
| F (ppm) | 1423 |
| Al (%) | 4.88 |
| K (%) | 0.38 |
| Si (%) | 17.48 |

Firstly, sample I was submitted to the following comminution stages:

i. Core drill crushing to a particle size smaller than 12.5 mm ii. Homogenization iii. Crushing to a particle size under 3.5 mm iv. Classification in closed circuit composed of a ball mill (charge of 40%) and spiral classifier.

The grinding circuit operated with 40% of steel ball charge. The overflow from the spiral classifier was directed to the rougher flotation feed, while the underflow was sent to the grinding circulating load. The rougher flotation feed presented P80 of 210 um. The rougher flotation was carried out in mechanical cells with capacity of 40 liters and operational conditions are shown in Table 2.

TABLE 2

Rougher flotation conditions

| Parameter | Value |
|---|---|
| Feed (kg/h) | 200 |
| Solids concentration feed (%) | 37 |
| Specific gravity feed (t/m$^3$) | 1.36 |
| Flotation pH (natural) | 8.5 |
| Number of cells | 3 |
| Flotation residence time (min) | 18.5 |

Collectors and frothers from phase I engineering development were again used in the plant. In order to avoid reagents' efficiency drop, due to slurry dilution and entrainment in the froth, the collector and frothers were distributed in different points of the rougher stage. Table 3 shows functions, dosage points and dosage of flotation reagents.

TABLE 3

Dosage and function of the flotation reagents

| Name | Function | Dosage local | Dosage (g/t) |
|---|---|---|---|
| Dithio + mono thiophosphate mixer | Collector | Rougher cells | 10 |
| Amyl-xanthate | Collector | Ball mill | 10 |
| | | Rougher cells | 10 |
| | | Scavenger-cleaner | 5 |
| Methyl isobutyl carbinol | Frother | Rougher | 10 |
| | | Scavenger-cleaner cell | 5 |
| Polypropylene glycol | Frother | Rougher cells | 12.5 |

Afterwards, the rougher concentrate was reduced to $P_{80}$ of 25 um. This re-grinding step was conducted in a vertical mill. Then, the rougher concentrate was submitted to a cleaner flotation circuit, composed of the following stages:

i. Re-grinding in a vertical mill with 42% of charge (stainless steel balls), in order to reduce the rougher concentrate to $P_{80}$ 25 um.

ii. Cleaner flotation step of the product obtained in step i in a flotation column (2.0 m×0.1 m). The cleaner concentrate was sent to a re-cleaner stage and the tailing followed to a scavenger-cleaner.

iii. Re-cleaner flotation of the product obtained at the end of step ii, carried out in a flotation column (2.0 m×0.1 m). The tailing returned to the cleaner feed.

iv. Scavenger-cleaner step conducted in three mechanical cells (capacity of 10 L) and fed with the cleaner's tailings from step ii.

The scavenger-cleaner concentrate was sent back to the cleaner step and the scavenger-cleaner tailings, together with the rougher tailings, have composed the final tailings.

This cleaner circuit configuration allows carrying out two runs in an open circuit, without the recycling of scavenger-cleaner concentrate and the re-cleaner tailing and influences on the final concentrate.

Alternatively to the open circuit, the plant operated in a closed circuit.

Flotation circulating load (scavenger-cleaner concentrate and re-cleaner tailing) was collected and submitted to a re-grinding ($P_{50}$≅7 um) and secondly, to a flotation step in mechanical cells. Fine flotation circuit is shown in FIG. 1.

Concentrate 2 was submitted to magnetic separation, using a magnetic yield induction of 2000 and 15000 Gauss.

Flotation Response of Sample I

Sample I was floated in two cleaner configurations, open and close circuit. Hence, in order to obtain a data of the distribution of the U—Pb oxides, runs 1 and 3 were carried out in an open cleaner circuit. Table 4 presents the results.

TABLE 4

Results of run 1 and 3 (open circuit).

| Parameter | Element | Flotation product Recleaner concentrate run 1 | run 3 |
|---|---|---|---|
| Quality | Cu (%) | 30.24 | 30.91 |
| | U (ppm) | 154 | 160 |
| | F (ppm) | 354 | 596 |
| Distribution (%) | Cu | 71.0 | 75.0 |
| | U | 4.1 | 4.6 |

| Parameter | Element | Flotation product Cleaner circulating load (scavenger-cleaner concentrate + recleaner tail) run 1 | run 3 |
|---|---|---|---|
| Quality | Cu (%) | 17.85 | 9.31 |
| | U (ppm) | 334 | 294 |
| | F (ppm) | 2400 | 2225 |
| Distribution (%) | Cu | 23.5 | 21.4 |
| | U | 5.0 | 8.0 |

It is possible to conclude that:

i. Re-cleaner concentrate shows copper and uranium average content of 30.6% and 157 ppm, respectively. Thus, the flotation concentrate is composed by 88% of chalcopyrite and 12% of gangue, which is distributed between iron oxides and silicates.

ii. Copper recovery is low, 71 and 75% due to the absence of the recirculation of the scavenger-cleaner's concentrate and re-cleaner's tailing, while uranium distribution is considered to be significant, between 5.0 and 8.0%.

The cleaner flotation circulating load (scavenger-cleaner's concentrate+re cleaner's tailing) is submitted to a re-grinding, in order to reduce this product to $P_{80}$ 10 um. Subsequently, the circulating load is floated, without collectors. FIG. 2 shows the results.

As noted in FIG. 2, it is necessary to point out:

i. The copper content of the scavenger's tailing is very high (3.14%) due to the low collision rate of fine particles ($P_{80}$=10 um) during flotation. Therefore, is obtained a low copper recovery of 72.4%.

ii. Copper and uranium grades of cleaner concentrate in fines flotation is 32.73% and 87 ppm, respectively. Since uranium's grade in the circulating load is 338 ppm, the flotation is able to decrease the uranium content in 74.3%.

iii. If rougher and cleaner concentrates from the fines flotation are combined, a higher uranium grade is achieved (178 ppm) due to the raised uranium distribution in the rougher concentrate (8.6%).

FIG. 3 presents run 2 results, performed in a cleaner closed circuit.

Based on these results, it is possible to observe:

i. The flotation's concentrate copper's grade and the recovery is 30.6% and 94.3%, respectively. The uranium content obtained in this concentrate is 203 ppm, which represents 6.36% of uranium distribution.

ii. The tailing of final flotation shows 0.09% of copper's grade, which is composed by rougher tailing (Cu=0.04%) and scavenger-cleaner tailing (Cu=0.41%).

iii. Cleaner concentrate improves the rougher concentrate in 307%. For this reason, copper grade increases from 8.5% to 26.14%. Cleaner copper recovery is 88.4%.

iv. Re-cleaner flotation shows a low enrichment factor (1.17) in relation to the cleaner concentrate. This fact indicates that the washing water from the re-cleaner column can be optimized, in order to improve the concentrate selectivity.

v. The uranium's grade of the Scavenger-cleaner concentrate is high, 477 ppm, an evidence of this deleterious build-up.

Scanning electron microscopy investigations on re-cleaner concentrates (closed and open circuit) detected that uranium oxides are preferentially associated with copper sulphides, approximately 46% and 62% for closed and open cleaner circuit, respectively. Moreover, uranium was frequently encountered into magnetite. In the closed re-cleaner circuit, 17% of the uranium content is only associated with magnetite and 24% is magnetite-chalcopyrite-uraninite associations. Since the open re-cleaner concentrate has low amount of middlings, all associations of uraninite-magnetite decreases to 19%. FIG. 4 and FIG. 5 present the uraninite distribution in re-cleaner concentrates.

Besides the relevant identification of uranium associations, scanning electron microscopy enables estimation of the released particle sizes of uranium oxides as well as uranium associations. Medium particle size of released uraninite is about 6.6 um, while particle size of uraninite-sulphide associations is smaller than about 3.5 um. Thus, uraninite also occurs in associations of very fine particles, under an optimum particle size for flotation, which is in the range between about 10 and about 100 um of diameter.

FIG. 6 shows uranium oxide distribution in a scavenger-cleaner concentrate from an open cleaner circuit (run 3). According to FIG. 6, released uranium rate is 56%, while the uranium associated with sulphides represents 18%. Particle size of uranium oxides is also very fine (≤3.5 um). This enhances deleterious entrainment towards froth bed.

Magnetic Separation of Sample I

In order to reduce the uranium content in the copper concentrate, flotation products from sample I was submitted to magnetic separation and flotation.

The magnetic separation was carried out in wet high intensity magnetic separator (WHIMS).

Based on the ore characteristics, such as particle size, specific gravity and mineralogical associations, the magnetic separation and gravity concentration were selected for purifying the concentrate.

The Table 5 shows results of the magnetic separation, which was carried out in pH=4.0 and pH=8.5 (slurry natural pH), using the re-cleaner concentrate from run 2.

TABLE 5

Copper and uranium grades in the magnetic separation from re-cleaner flotation concentrate (run 2)

| | pH | | | |
|---|---|---|---|---|
| | 4.0 | | 8.5 (natural) | |
| Product | Cu (%) | U (ppm) | Cu (%) | U (ppm) |
| Non-magnetic 15000 G | 33.10 | 135 | 33.03 | 84 |
| Magnetic 15000 G | 26.91 | 101 | 26.67 | 384 |
| Magnetic 2000 G | 17.90 | 270 | 18.85 | 329 |
| Feed | 29.50 | 158 | 29.61 | 158 |

In pH=4.0 and pH=8.5, the non-magnetic copper recoveries were 78.9 and 80% respectively, while uranium distribution was 60.1% in pH 4.0 and 38.2% in pH=8.5. Therefore, the magnetic separation was able to remove around 60% of uraninite from the run 2 re-cleaner concentrate. Besides, the copper grade was raised from 29.5% to 33.10% in the non-magnetic product. Copper recovery, however, could be optimized by washing water adjustment.

On the other hand, the copper content in the magnetic tailing was very high, approximately 20%. In spite of high uranium content (>200 ppm), the copper magnetic tailing could be recovered by flotation, after re-grinding to $P_{80}$ or 10 um. The software simulation indicated that copper overall recovery would increase approximately 3%.

2. Second Plant Experiment (Sample II)

In this experiment, a sample of ore with lithological composition of magnetic breccias (50%) and chloritic breccias (50%) was used. Sample II is composed with high content of uranium.

Chemical analysis of sample II, containing 6 ton of core drill ore, are presented in Table 6, as follows.

Firstly, sample II was submitted to the following comminution stages:

i. Core drill crushing to a particle size smaller than 12.5 mm.
ii. Homogenization
iii. Crushing to a particle size smaller than 3.5 mm

TABLE 6

Chemical analysis of sample II

| Element | Assay |
|---|---|
| Cu (%) | 2.35 |
| Au (g/t) | 1.55 |
| S (%) | 2.42 |
| Fe (%) | 30.8 |

TABLE 6-continued

Chemical analysis of sample II

| Element | Assay |
|---|---|
| U (ppm) | 150 |
| F (ppm) | 3827 |
| Al (%) | 3.55 |
| Si (%) | 13.7 |

The grinding circuit has operated with 40% of steel ball charge. The overflow from the spiral classifier was destined to the rougher flotation feed, while the underflow was sent to the grinding circulating load. The rougher flotation feed presented $P_{80}$ of 210 um. Classification in closed circuit composed of ball mill (charge of 40%) and spiral classifier.

The rougher flotation was carried out in mechanical cells with capacity of 40 liters. Operational conditions are summarized in the Table 7, as follows.

TABLE 7

Rougher flotation conditions

| Parameter | Value |
|---|---|
| Feed (kg/h) | 200 |
| Solids concentration feed (%) | 37 |
| Specific gravity feed (t/m$^3$) | 1.36 |
| Flotation pH (natural) | 8.5 |
| Number of cells | 4 |
| Flotation residence time (min) | 18.1 |

Table 8 shows functions, dosage points and dosage of flotation reagents.

TABLE 8

Dosage and function of the flotation reagents

| Name | Function | Dosage local | Dosage (g/t) |
|---|---|---|---|
| Dithio + monothiophosphate mixer | Collector | Rougher cells | 15 |
| Amyl-xanthate | Collector | Ball mill | 15 |
| | | Rougher cells | 12.5 |
| | | Scavenger-cleaner | 5 |
| Methyl isobutyl carbinol | Frother | Rougher | 12.5 |
| | | Scavenger-cleaner cell | 5 |
| Polypropylene glycol | Frother | Rougher cells | 12.5 |

Since the chaicopyrite was not released at $P_{50}$ of 212 um, the rougher concentrate was submitted to a re-grinding step at $P_{50}$ of 20 and 30 um. After re-grinding, the rougher concentrate was sent to a cleaner circuit, comprising the following steps:

i. Re-grinding in a vertical mill with 42% of charge (stainless steel balls), in order to reduce the rougher concentrate to $P_{50}$ 20 and 30 um.
ii. Cleaner flotation step of the product obtained in step i in a flotation column (4.7 m×0.1 m). The cleaner concentrate was sent to a re-cleaner stage and the tailing followed to a scavenger-cleaner.
iii. Re-cleaner flotation of the product obtained at the end of step ii, carried out in a flotation column (2.0 m×0.1 m). The tailing returned to the cleaner feed.
iv. Scavenger-cleaner step was conducted in column (2.0 m×0.1 m), in order to improve the selectivity of its concentrate.

The scavenger-cleaner concentrate was sent back to the cleaner step ii and the scavenger-cleaner tailings, together with the rougher tailings composed the final tailing.

This cleaner circuit configuration allowed carrying out three runs in open circuit, with no recycling of scavenger-cleaner concentrate and re-cleaner tailing, in order to evaluate deleterious behavior of each flotation product, without middles influence on the final concentrate. Besides these open circuit runs, the plant operated six runs in closed circuit, with the aim of estimating flotation performance and deleterious build-up.

In addition, there was a regrinding of the rougher concentrate from one open circuit test in 20 um.

Flotation Response of the Sample II

Sample II of high uranium content was floated in two cleaner configurations, open and closed circuit. Firstly, the ore was submitted to a rougher flotation and after to a cleaner flotation. It is important to point out that the scavenger-cleaner was carried out in a flotation column due to the necessity to improve selectivity.

FIG. 7 shows the average results of runs 1 and 2, which were conducted in an open cleaner circuit.

The re-cleaner concentrate from these runs achieved a very high selectivity, since copper and uranium grade were 33.52% and 69 ppm respectively. This fact indicated increasing of the chalcopyrite presence in the re-cleaner (>95%), since sulphide is the principal source of copper. Therefore, the presence of low gangue in the re-cleaner concentrate (<5%) enables a reduction of the uranium content to values below 75 ppm.

Regarding to the scavenger-cleaner flotation, which was performed in a column, the results indicated the increase of selectivity (copper grade was 30.2%). On the other hand, uranium grade was still high (220 ppm), which could raise the build-up of this deleterious element in the cleaner circuit.

Another important observation is that no difference was found between $P_{80}$ obtained in the rougher re-grinding. Table 9—Quality of re-cleaner concentrates in P80 different compares the results.

TABLE 9

Quality of re-cleaner concentrates in $P_{80}$ different

| $P_{80}$ rougher concentrate (um) | Cu (%) | U (ppm) | F (ppm) |
|---|---|---|---|
| 20 | 33.31 | 67 | 211 |
| 30 | 33.52 | 69 | 229 |

Besides the runs in an open cleaner circuit, the plant operated six flotation tests in a closed cleaner circuit, in order to evaluate the influence of cleaner circulating load (scavenger-cleaner concentrate and re-cleaner tailing) on flotation concentrate from sample II.

TABLE 10

Flotation performance in closed cleaner circuit from the sample II.

| | Concentrate quality | | |
|---|---|---|---|
| Runs | Cu (%) | U (ppm) | Copper recovery (%) |
| A | 31.74 | 110 | 87.4 |
| B | 28.24 | 149 | 72.3 |
| C (*) | 29.5 | 88.5 | 16.5 |
| D | 30.1 | 128.1 | 77.1 |
| E | 30.4 | 112.7 | 71.1 |
| F | 31.1 | 136.9 | 71.9 |

TABLE 10-continued

Flotation performance in closed cleaner circuit from the sample II.

| | Concentrate quality | | |
|---|---|---|---|
| Runs | Cu (%) | U (ppm) | Copper recovery (%) |
| G (*) | 29.9 | 118.5 | 62.9 |
| H (*) | 29.9 | 89.8 | 45.5 |

(*) Due to operational problems with feed pumps of the cleaner and re-cleaner columns, runs C, G and H were excluded of evaluations.

Based on Table 10 and FIG. 8, it is possible to observe:

i. Maximum copper grade the in re-cleaner concentrates was 31.7%, with uranium content of 110 ppm. This fact evidences the build-up of uranium in the cleaner circulating load.

ii. Cleaner recovery was low, ~38.6%, due to high copper enrichment in this column. On the other hand, re-cleaner obtained high recovery values (>95%), probably due to good chalcopyrite release in this stage.

iii. Despite the higher copper selectivity in cleaner circuit, the uranium content continued to increase (>100 ppm). This indicated presence of chalcopyrite-uraninite associations or build-up of uraninite fines in the flotation concentrate.

iv. Scavenger-cleaner flotation in column presented low recovery due to high copper content in its tailing, 3.1%. Probably, there were low collision rates due to small particle sizes ($P_{80}$–30 μm).

Magnetic Separation of the Sample II

In order to reduce the uranium content in copper concentrate, the flotation products from samples II was submitted to process tests, such as magnetic separation concentration. Magnetic separation tests were carried out in wet high intensity magnetic separator (WHIMS). The behavior of re-cleaner and scavenger-cleaner concentrates was evaluated in this process.

FIGS. 9 and 10 present the results of the magnetic separation in a closed circuit of the re-cleaner flotation concentrate from sample II. Magnetic separation test showed 28.3% copper grade in feed.

The magnetic separation allowed a 46 ppm decrease in uranium grade of non-magnetic product. Copper grade was raised to 31.4% in this product and copper recovery was 89.9%.

The scavenger-cleaner flotation concentrate from sample II in a closed circuit cleaner was also submitted to a magnetic separation in order to reduce uranium content in cleaner circulating load. FIG. 11 shows the copper and uranium grade behavior in the test.

Despite the fact that magnetic separation of scavenger-cleaner flotation concentrate resulted in selectivity between chalcopyrite and uraninite (Gaudin selectivity index ~1.3), the uranium content in non-magnetic product was raised, >180 ppm. This indicated that the uraninite kept build-up in the cleaner flotation circuit.

3. Third Plant Experiment (Sample III)

In this experiment, a sample of typical ore which has the lithological composition magnetitic breccias (24%), chloritic breccias (64%) and intrinsic dilution (12%) composed the sample III, with low content of uranium was used. This sample consisted of 5 ton from core drill of ore samples and its chemical analysis results are in Table 11.

TABLE 11

Chemical analysis results of sample III

| Element | Assay |
|---|---|
| Cu (%) | 1.5 |
| S (%) | 1.4 |
| Fe (%) | 21.8 |
| U (ppm) | 74 |
| F (ppm) | 2168 |
| Al (%) | 4.4 |
| K (%) | 0.5 |
| Si (%) | 18.3 |

Firstly, sample III was submitted to the following comminution stages:

i. Classification of core drill samples in drums according to the lithology and copper grade (high, medium and low)
ii. Crushing to a particle size smaller 3.5 mm of each sample drum
iii. Duplicate chemical assays (Cu and U) on each sample drum
iv. Homogenization of crushed and analyzed samples
v. Classification in closed circuit composed of ball mill (charge of 40%) and spiral classifier.

The grinding circuit operated with 40% of steel ball charge. Spiral classifier overflow was destined for rougher flotation feed, while underflow was sent to the grinding circulating load. The rougher flotation feed must present $P_{80}$ of 210 um, however obtained $P_{80}$ was 150 um.

Rougher flotation was carried out in mechanical cells with capacity of 40 liters. Operational conditions are shown in Table 12.

TABLE 12

Rougher flotation conditions

| Parameter | Value |
|---|---|
| Feed (kg/h) | 200 |
| Solids concentration feed (%) | 38 |
| Specific gravity feed (t/m$^3$) | 1.36 |
| Flotation pH (natural) | 8.5 |
| Number of cells | 3 |
| Flotation residence time (min) | 18.5 |

Collectors and frothers from phase I engineering development were again used in the plant. In order to avoid reagents' efficiency drop, due to slurry dilution and entrainment in the froth, the collector and frothers were distributed in different points of the rougher stage. Table 13 shows functions, dosage points and dosage of flotation reagents.

TABLE 13

Dosage and function of the flotation reagents

| Name | Function | Dosage local | Dosage (g/t) |
|---|---|---|---|
| Dithio + monothiophosphate mixer | Collector | Rougher cells | 20 |
| Amyl-xanthate | Collector | Ball mill | 20 |
| | | Rougher cells | 10 |
| | | Scavenger-cleaner | 10 |
| Methyl isobutyl carbinol | Frother | Rougher | 10 |
| | | Scavenger-cleaner cell | 5 |
| Polypropylene glycol | Frother | Rougher cells | 12.5 |

Afterwards, the rougher concentrate was reduced to $P_{80}$ of 25 um. This re-grinding step was conducted in a vertical mill. Then, the rougher concentrate was submitted to a cleaner flotation circuit, composed of the following stages:

i. Re-grinding in a vertical mill with 42% of charge (stainless steel balls), in order to reduce the rougher concentrate to $P_{50}$ 25 um.
ii. Cleaner flotation step of the product obtained in step i in a flotation column (2.0 m×0.1 m). The cleaner concentrate was sent to a re-cleaner stage and the tailing followed to a scavenger-cleaner.
iii. Re-cleaner flotation of the product obtained at the end of step ii, carried out in a flotation column (2.0 m×0.1 m). The tailing returned to the cleaner feed.
iv. Scavenger-cleaner step conducted in three mechanical cells (capacity of 10 L) and fed with the cleaner's tailings from step ii.

The Scavenger-cleaner was conducted in three mechanical cells (capacity of 10 L) and was fed with cleaner tailings. The scavenger-cleaner concentrate was sent back to the cleaner stage and the scavenger-cleaner tailings together with the rougher tailings composed the final tailings.

The plant operated in a closed circuit, this test was conducted to estimate flotation performance and concentrate quality. Besides the plant test, sample III was also submitted to locked cycle test (LCT) and opened cleaner test, where these tests followed the same preparation procedures from $3^{11}$ plant experiment, except for the regrinding of rougher concentrate, 20 urn P50.

LCT Flotation and Magnetic Responses of the Sample III

Firstly, this sample was submitted to open cleaner flotation test and LCT (locked cycle test). Table 14 presents the results of the tests, in which the rougher concentrate regrinding stage was carried out about 20 μm $P_{80}$.

TABLE 14

Results of the concentration tests

| | | Recleaner flotation | | No magnetic concentrate | |
|---|---|---|---|---|---|
| CDM tests | Element | Open cleaner | LCT | Open cleaner | LCT |
| Quality | Cu (%) | 30.4 | 30.8 | 32.44 | 33.8 |
| | U (ppm) | 123.4 | 138 | 71.4 | 11 |
| Distribution (%) | Mass | 4.5 | 4.4 | 3.7 | 3.7 |
| | Cu | 88.4 | 92.0 | 80.9 | 84.9 |
| | U | 7.5 | 8.2 | 3.5 | 4.5 |

Obtained flotation concentrate in LCT showed the copper and uranium contents of 30.8% and 138 ppm respectively, and copper recovery about 92%. These results ratify the former studies on typical ore, such as variability studies and plant tests (experiments I and II).

In addition, flotation concentrate was submitted to high intensity magnetic separation, which produced a non-magnetic concentrate assaying 33.8% copper and 91 ppm uranium at a copper global recovery of 84.9%. As observed in the plant experiments I and II, these results also indicate that the magnetic separation can be able to reduce the uranium content in the concentrate to smaller values than 100 ppm.

A particle mineral analysis by scanning electronic microscopy was completed on the magnetic separation products to determine uranium deportment and fragmentation characteristics. Uranium bearing minerals are U—Pb oxides with 61% U and 15% Pb. In the non-magnetic concentrate, the U—Pb oxides are predominantly associated to grains of chalcopyrite±gangue minerals. Moreover, it was observed that the uraninite-chalcopyrite associations tend to have much finer grain average sizes (<10 um). In turn, magnetic products also showed high amounts fine uraninite-chalcopyrite associations.

These facts can be observed in Table 15 and FIG. 12.

TABLE 15

Uraninite associations in the magnetic separation products

| Uraninite associations | Particle counts | Coarser particle size (um) Average | Deviation |
|---|---|---|---|
| Non-magnetic product | | | |
| Chalcopyrite ± gangue | 56 | 2.51 | 1.28 |
| Liberated particles | 11 | 6.02 | 4.60 |
| 17,000 Gauss magnetic product | | | |
| Chalcopyrite ± gangue | 78 | 3.86 | 3.52 |
| Galena ± gangue | 6 | 5.26 | 2.72 |
| Gangue | 26 | 3.76 | 2.33 |
| Liberated particles | 11 | 16.39 | 8.77 |
| 2,000 Gauss magnetic product | | | |
| Chalcopyrite ± gangue | 125 | 2.68 | 1.68 |
| Pyrite ± gangue | 2 | 8.80 | 2.83 |
| Gangue | 105 | 2.71 | 1.39 |
| Liberated particles | 2 | 6.82 | 1.81 |

Despite the higher uranium content (>400 ppm) and fine chalcopyrite-uraninite associations, magnetic products tend to present elevated copper contents (>16%), what was also observed in I and II plant experiments. This fact indicates a possible improvement of metallurgical recovery through finer regrinding of this product.

Another highlight was an increase in uranium concentration in the re-cleaner concentrate, when there is pulp recirculation, such as scavenger-cleaner concentrate and re-cleaner tailings. Since the middlings from flotation circuit present elevated amount of chalcopyrite-uraninite associations, these non-liberated particles can be collected by bubbles and reported to froth layer.

Flotation Plant and Magnetic Responses of Sample III

A second step of metallurgical tests using sample III was conducted at the plant. Flotation tests were performed in closed circuit and the results are shown in FIG. 14.

Based on these 3rd plant experiment results, it is possible to observe:

i. In this plant campaign the flotation concentrate copper grade and recovery were 31.5% and 91.4% respectively, while the uranium content in this product was 124 ppm. Even though typical ore presents a good flotation response, the uranium content remains high in re-cleaner concentrate, which indicates the weak liberation of uraninite.

ii. Final tailing showed a slightly high copper content (0.22% Cu) due to magnetic fraction still presents elevated copper content (17.3% Cu). This fact can enable a metallurgical recovery improvement.

iii. Re-cleaner flotation enriched the rougher concentrate in 242%. For this reason, copper grade increased from 13% to 31.5%, what indicates that washing water of the re-cleaner column has a significant effect on selectivity of flotation concentrate.

iv. Scavenger-cleaner concentrate and re-cleaner tailings presented the uranium contents of 203 ppm and 356 ppm respectively. These elevated uranium concentrations confirm that the deleterious build-up occurs in the flotation middlings (middling).

Copper Recovery in the Magnetic Product (Tailing) of the Sample III:

The magnetic product (tailing) is re-grinded to less than 10 um and flotation can offer a possible way for recovering chalcopyrite from magnetic product, without the increase of uraninite in flotation concentrate. Magnetic product from the plant was floated in bench scale. Firstly this product was submitted to fine regrinding to about 9 μm $P_{80}$ in ball mill (50% ball charge). The flotation responses of magnetic product are presented in Table 16 and 17.

Run 1: $P_{80\ (feed)}$=9 um; collector dosage (dithio+monothiophosphate)=20 g/t; frother dosage (MIBC)=10 g/t and $pH_{pulp}$=8.6 (natural pH).

TABLE 16

Results of flotation run 1 with magnetic product

| Product | Chemical quality % Cu | U (ppm) | Distribution (%) Mass | Cu | U |
|---|---|---|---|---|---|
| Cleaner concentrate | 33.4 | 90 | 21.2 | 41.5 | 5.8 |
| Cleaner tailings | 24.4 | 491 | 10.2 | 14.6 | 15.2 |
| Rougher concentrate | 30.5 | 220 | 31.4 | 56.0 | 21.0 |
| Rougher tailings | 11.0 | 380 | 68.6 | 44.0 | 79.0 |
| Feed | 17.1 | 330 | 100.0 | 100.0 | 100.0 |

Run 2: $P_{80}$ (feed)=9 μm; depressant dosage (carboxyl methyl cellulose-CMC)=200 g/t; collector dosage (dithio+monothiophosphate)=20 g/t; frother dosage (MIBC)=10 g/t and $pH_{pulp}$=8.6 (natural pH).

TABLE 17

Results of flotation run 2 with magnetic product.

| Product | Chemical quality % Cu | U (ppm) | Distribution (%) Mass | Cu | U |
|---|---|---|---|---|---|
| Rougher concentrate | 33.0 | 108 | 3.9 | 7.4 | 1.3 |
| Rougher tailings | 16.9 | 325 | 96.1 | 92.6 | 98.7 |
| Feed | 17.6 | 316 | 100.0 | 100.0 | 100.0 |

Based on the results of the magnetic product flotation tests, it can be observed:

i. There was a significant decrease of the uranium content in flotation concentrate, due to low chemical affinity between dithiophosphates and the uraninite particles, since this mineral is an oxide. Moreover, liberated uraninite did not tend to adhere to the bubbles, according to the uranium content increase in flotation tailings.

ii. Despite the high chalcopyrite content in flotation concentrate (% Cu=33.4%), the uranium content still remains about 90 ppm, which indicates the occurrence of the finer uraninite-chalcopyrite associations (<5 um).

iii. Low copper recoveries have been attributed to the collision efficiency decrease of the fine particles. On the other hand, in spite of the slight uranium content increase, copper fines flotation can enable a metallurgical recovery increase for the project.

iv. In the run 2, the results evidenced that CMC caused strong depression of chalcopyrite and, therefore, reduction of copper recovery.

Therefore, recovering chalcopyrite from the magnetic product can lead to an increase of approximately 5% in the copper recovery. The metallurgical balance of concentration circuit with inclusion of magnetic product flotation is shown in FIG. 15, which considers plant throughput of 691.3 t/h and % Cu=1.5%.

According to the process tests and analysis performed, uraninite is mainly associated with chalcopyrite and magnetite. Moreover, these chalcopyrite-uraninite associations are very small, below 5 um.

Since uraninite has not good liberation even at finer regrinding, the uranium is considered strongly dependent on copper content in final concentrate. Hence, high copper concentrate grades are able to reduce the uranium in concentrate below 94 ppm.

Although different regrind sizing, 30 um and 20 um P80, are not able to reduce the uranium in flotation concentrates, it is possible that the 20 um P80 can enhance the selectivity of magnetic separation. On the other hand, ultrafine particles can lead to an increase of magnetic particles in the non-magnetic concentrate due to entrainment. These facts indicate that regrinding must be projected to obtain concentrates with P80 different, which will depend on operation.

However, re-cleaner flotation was able to reduce uraninite entrainment in flotation concentrate, even though uraninite grade is still significantly high (>120 ppm). Furthermore, magnetic separation removed around 40% uraninite from the re-cleaner flotation concentrate, decreasing the uranium content to 88 ppm in the final concentrate.

The magnetic product flotation was included in concentration circuit in order to enhance copper and gold recovery. Therefore, based on process studies, the estimated copper and gold recoveries are around 90.1% and 70% respectively for typical ore.

We claim:

1. A process for removing uranium from copper concentrates via magnetic separation comprising the steps of:

i. magnetically separating the copper concentrates to provide a magnetic fraction and a non-magnetic fraction with a size distribution of about 15 micron to about 40 micron ($P_{80}$), the magnetic fraction having a uranium content of about 20 ppm to about 100 ppm, and obtaining about 75% to about 99.99% non-magnetic copper;

ii. grinding the magnetic fraction to produce a magnetic copper concentrate having a fine size distribution of about 5 micron to about 15 micron ($P_{80}$) and a uranium content of about 100 ppm to about 300 ppm;

iii. fine flotation of the magnetic copper concentrate to produce a recovered copper concentrate having about 0.01% to about 25% by weight copper and a uranium content of about 100 ppm to about 300 ppm; and iv. mixing the non-magnetic fraction with the recovered copper concentrate of step iii to produce a final concentrate having a uranium content of about 40 ppm to about 150 ppm and about 65% to about 99.99% copper.

2. The process for removing uranium from copper concentrates via magnetic separation, according to claim 1, wherein the uranium comprises uranium oxides, copper sulfides, magnetite and other oxides.

3. The process for removing uranium from copper concentrates via magnetic separation, according to claim 1, wherein the non-magnetic fraction comprises a uranium content of about 20 ppm to about 100 ppm.

4. The process for removing uranium from copper concentrates via magnetic separation, according to claim 1, wherein the final concentrate has a uranium content below about 100 ppm.

5. The process for removing uranium from copper concentrates via magnetic separation, according to claim 1, wherein the magnetic separation is performed by a wet high intensity magnetic separator (WHIMS).

6. The process for removing uranium from copper concentrates via magnetic separation, according to claim 2, wherein the copper sulphides, magnetite, and other oxides make up 54%, 14%, and 7%, respectively, of the uranium.

* * * * *